United States Patent [19]

Brown

[11] Patent Number: 4,534,181

[45] Date of Patent: Aug. 13, 1985

[54] COOLING SYSTEM

[75] Inventor: Claude D. Brown, Grass Valley, Calif.

[73] Assignee: BBC Industries, Inc., Grass Valley, Calif.

[21] Appl. No.: 575,961

[22] Filed: Jan. 31, 1984

[51] Int. Cl.[3] ..... F25D 17/00

[52] U.S. Cl. ..... 62/180; 62/209

[58] Field of Search ..... 62/180, 209; 236/49, 236/91 F

[56] References Cited

U.S. PATENT DOCUMENTS

| | | | |
|---|---|---|---|
| 3,831,663 | 8/1974 | Pithie | 165/26 |
| 4,094,166 | 6/1978 | Jerles | 62/180 |
| 4,136,730 | 1/1979 | Kinsey | 165/12 |
| 4,140,274 | 2/1979 | Nabinger | 236/11 |
| 4,199,023 | 4/1980 | Phillips | 165/12 |
| 4,471,632 | 9/1984 | Nishi et al. | 62/208 |

*Primary Examiner*—William E. Wayner
*Assistant Examiner*—John Sollecito
*Attorney, Agent, or Firm*—Townsend & Townsend

[57] ABSTRACT

An improved cooling system includes a vapor compression refrigeration loop made up of a compressor, an expansion valve, an evaporator and a condenser. A cool air fan blows air past the cool surfaces of the evaporator. The cooled air is directed to the interior of the structure by a cool air duct. A thermostat actuates the cool air fan and the compressor when the temperature in the structure rises above a selected value. Recognizing that cooling systems are oversized, and thus run inefficiently during normal operation, a compressor cycling switch is used to cycle the compressor on and off during the cool demand cycles according to the air temperature in the cool air duct. This increases the efficiency of the system by reducing back pressure on the compressor and reducing icing of the system.

3 Claims, 1 Drawing Figure

COOLING SYSTEM

BACKGROUND OF THE INVENTION

One type of conventional cooling system operates on the basis of a vapor compression refrigeration cycle. Such systems typically include a refrigerant compressor, an expansion valve, an evaporator, and a condenser, all connected in series in a closed loop. A cool air fan is used to blow air across the cooled surfaces of the evaporator. The cooled air is then directed into the interior of the structure to be cooled through to a cool air duct. A thermostat, sensing the temperature within the structure, actuates the cool air fan and the compressor during each cool demand cycle, which is triggered when the interior structure temperature is above a selected value.

With most cooling systems the cool air fan and the compressor turn on at the same time when the thermostat calls for cooling and run continuously during the entire cool demand period. Both the cool air fan and compressor turn off at the same time at the end of the cool demand period. In some cases, the switching off of the cool air fan can be delayed for a certain period to better utilize the coolness of the evaporator surfaces.

One problem with virtually all well-designed cooling systems is that they are designed to cool the structure to a chosen temperature, for example 78°, on the hottest days expected in that location. Cooling systems are therefore sized so the evaporator can absorb enough heat from the incoming air to deliver sufficiently cool air to the interior of the structure to cool the structure to the chosen temperature during the hot-test days. This leads to a cooling system which is oversized when operating at lower, and more common, temperatures. The excess capacity reduces the efficiency of the system for several reasons. The evaporator coils, during moderately hot days, remain cooler than they would be during the hottest days. Because the evaporator coils remain cooler, various portions of the system often ice up, especially in high humidity environments. This ice acts as an insulator, further reducing the efficiency of heat transfer between the air to be cooled and the evaporator. In some cases operating under these adverse conditions requires that an energy penalty of up to 50% be paid.

One method used to reduce icing has been to mount heater coils at appropriate places where icing may normally occur. However, this method is an obviously inefficient solution and does not address or solve the underlying problem.

SUMMARY OF THE INVENTION

The present invention is directed to an improved, energy efficient cooling system, incorporating a novel cooling system controller, which is a modification of conventional cooling systems of the type using a vapor compression refrigeration cycle. The cooling system controller is simple and inexpensive in design, easy to install and is inherently tuned to be responsive to the air leaving the evaporator.

The improved cooling system includes a compressor, an expansion valve, an evaporator, and a condenser connected in a closed loop to provide a vapor compression refrigeration cycle. A cool air fan is used to draw air from the structure interior and blow it past the cool coils of the evaporator. The cooled air is directed back to the interior of the structure by a cool air duct. A thermostat turns on the cool air fan and the compressor when the temperature in the house rises above a selected value (e.g., 78° F.).

The above elements are all known in the art. However, recognizing that cooling systems are necessarily oversized for operation under normal conditions, and thus run inefficiently during normal operation, a duct temperature switch is used to cycle the compressor on and off during the cool demand period according to the air temperature in the cool air duct. When the temperature in the cool air duct drops below a first temperature (e.g., 40° F.), the duct temperature switch turns the compressor off. However, since the cool air fan continues to operate under the control of the thermostat during the cool demand period, the air passing the evaporator coils continues to be cooled by the residual coolness of the evaporator coils. In addition, the high pressure refrigerant downstream of the compressor continues to bleed through the system until the pressure differential on either side of the expansion valve diminishes. Therefore the evaporator continues to be cooled by the refrigerant bleeding through the system even after the compressor is shut off. Since cooling systems often include an accumulator tank between the output of the compressor and the expansion valve, the bleed through can last for several minutes, during which time the evaporator is kept quite cold. When the temperature in the cool air duct rises above a second temperature (e.g. 60° F.), the duct temperature switch closes thus turning the compressor on.

A key feature of the invention is that since the compressor is cycled on only at the start of a cool demand period and thereafter only when the air passing through the cool air duct rises above the second temperature, the evaporator is not allowed to become overly cold, which could lead to icing up, so efficiency is enhanced. The compressor is restarted during a cool demand period only after the cool air duct temperature rises above the second temperature; this indicates that the temperature and pressure in the evaporator have risen significantly and the compressor head pressure has dropped. Proper selection of the second temperature insures that turning the compressor back on when the duct temperature reaches the second temperature will occur only after head pressure on the compressor has diminished sufficiently so as not to place an undue strain on the compressor. This is important since if the compressor head pressure were at or near the high pressure existing soon after the compressor is turned off, turning the compressor on under such conditions would place an excessively great load on the compressor motor, possibly burning it out.

Part of the present invention lies in the recognition that cooling systems are oversized and thus operate inefficiently under normal conditions. The present invention provides a solution which is simple in construction, simple to install, will not harm the system and is inherently tuned to the particular cooling system and cooled structure.

Other features and advantages of the present invention will appear from the following description which the preferred embodiment has been set forth in detail in conjunction with the accompanying drawing.

DETAILED DESCRIPTION OF THE PREFERRED EMBODIMENT

Figure 1:
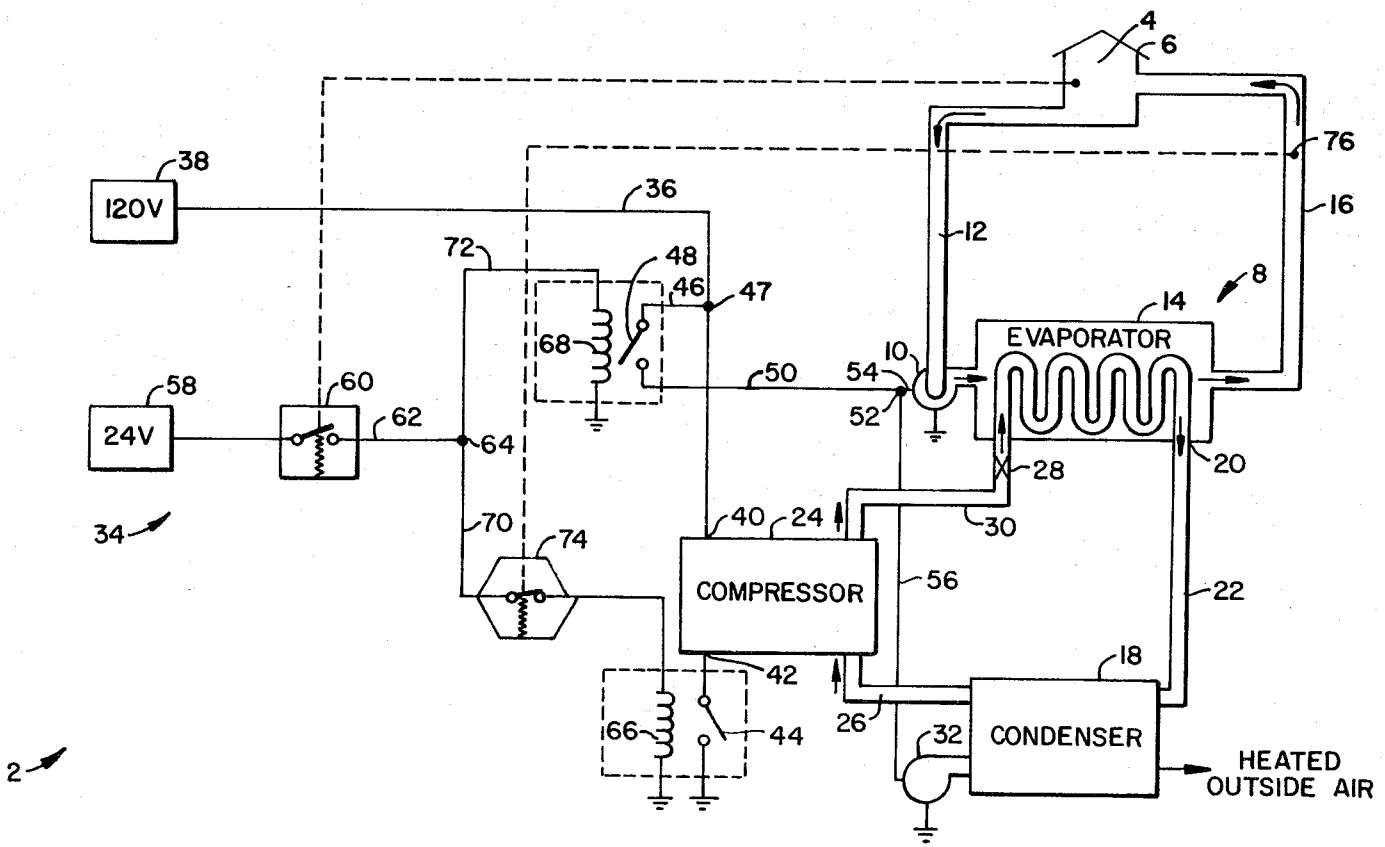
FIG. 1 is a schematic diagram of an improved cooling system made according to the invention.

FIG. 1 shows an improved cooling system 2 for cooling the interior 4 of a house 6. System 2 includes a vapor compression refrigeration loop 8 and a cool air fan 10 which circulates air from interior 4 of house 6, through a return duct 12, past a cooling evaporator 14 in loop 8, and through a cool air supply duct 16 for return to interior 4. Loop 8, in addition to evaporator 14, includes a condenser 18 connected to a refrigerant outlet 20 of evaporator 14 by a line 22, a compressor 24 fluidly connected to condenser 18 by a condenser line 26 and an expansion valve 28 placed along a line 30 between compressor 24 and evaporator 14. A hot air fan 32 is used to blow air across condenser 18 to remove heat from the refrigerant passing through the condenser.

Cool air fan 10, compressor 24 and hot air fan 32 are actuated by a control circuit 34. Control circuit 34 includes a first line 36 connected to a higher voltage source 38, typically 120 or 240 volts AC, at one end and an input terminal 40 of compressor 24 at the other. Compressor 24 includes an output terminal 42 connected to ground through a normally open compressor relay switch 44. Fans 10 and 32 are electrically connected between source 38 and ground through line 36, a line 46 connected to a node 47 along line 36, a normally open fan relay switch 48, and a line 50 connecting switch 48 with a node 52; node 52 is connected to fans 10, 32 through lines 54, 56 so the fans are in parallel.

A lower voltage, typically 24 volt, power source 58 is connected to a thermostat 60 which senses the temperature within interior 4 of house 6. Thermostat stat 60 is connected in series along a line 62 connecting source 58 and a node 64. Node 64 is connected to relay actuators 66, 68, which close relay switches 44, 48 when energized, through lines 70, 72.

The above described system is conventional. According to the present invention, a normally closed duct switch 74 is connected in series along line 70 and is used to interrupt the current flow along line 70 to relay actuator 66 during a cool demand period. Temperature switch 74 is operably connected to a temperature sensor 76 positioned along cool air supply duct 16. Switch 74 opens, turning compressor 24 off, when the temperature sensed by temperature sensor 76 is below a first temperature (e.g., 40° F.) and re-closes when sensor 76 indicates that the air temperature in duct 16 is above a second temperature (e.g., 60° F.).

In operation, a cool demand period is initiated when thermostat 60 senses that the temperature within interior 4 is above a selected value, for example 78° F. This causes thermostat 60 to close, thus energizing relay actuator 66 through normally closed duct temperature switch 74 and relay actuator 68. Normally open relay switches 44, 46 then close and apply the higher voltage from source 38 to fans 10, 32 and compressor 24. This actuates vapor compression refrigeration loop 8 which operates in a conventional manner. Evaporator 14 is cooled by the refrigerant passing through it so air blown past evaporator 14 by cool air fan 10 is cooled before it returns to interior 4 through cool air supply duct 16.

At the start of a cool demand period, the temperature of the air passing temperature sensor 76 is relatively elevated, for example 78° F. As evaporator 14 begins to cool, the air passing sensor 76 also drops in temperature. Once the air in cool air supply duct 16, as sensed by temperature sensor 76, reaches a first temperature, such as 40° F., normally closed duct temperature switch 74 opens, thus de-energizing relay actuator 66 to cause normally open compressor relay switch 44 to open. This turns off compressor 24 but allows fans 10, 32 to remain on. (This assumes that the temperature within interior 4, as sensed by thermostat 60, has not dropped sufficiently to cause thermostat to open so that the cool demand period is continued.) The temperature of evaporator 14 remains quite low because of the residual pressure along line 30 between compressor 24 and expansion valve 28. Refrigerant thus continues to flow through expansion valve 28 to continue cooling evaporator 14. Thereafter the temperature of evaporator 14 begins to rise so the temperature of the cool air passing temperature sensor 76 also rises. When sensor 76 reaches a second temperature, for example 60° F., duct temperature switch 74 closes which re-energizes actuator 66 causing relay switch 44 to close thus turning compressor 24 back on. Once the air duct temperature at sensor 76 drops below the first temperature, the above cycle repeats. This process continues so long as thermostat 60 senses that cooling is demanded in house 6.

It has been found that using 40° F. as the temperature at which duct temperature switch 74 opens, and 60° F. as the temperature at which the duct temperature switch recloses, provides good comfort and efficient operation of the system. Experimental results indicate that a temperature range of between 58° F. and 68° F. is a suitable for the second temperature.

The present invention automatically and inherently compensates for the various individual operating conditions, including the type and size of vapor compression refrigeration loop 8, the thermal aspects of house 6 and the outside temperature. Adding switch 74 and sensor 76 does not degrade the performance of cooling system 2 since the air passing through duct 16 and into house 6 during a cool demand cycle will always be between the first and second temperatures, typically 40° F. and 60° F. When the outside temperature is at the maximum temperature at which system 2 is designed to work, the temperature of the cooled air passing sensor 76 will probably never drop below 40° F. so that compressor 24 will never be turned off during a cool demand cycle. Thus, adding duct temperature switch 74 and temperature sensor 76 in a cool air supply duct easily, safely and inexpensively increases the overall operating efficiency of the system without degrading its ability to provide enough cooling during the hottest days.

Cooling system 2 is shown using both higher and lower voltage power sources 38, 58 for safety. In this way, much of the wiring of control circuit 34 is at the lower, and much safer voltage for increased safety. If desired, other electrical arrangements may be used so long as compressor 24 and cool air fan 10 are essentially connected in parallel so that duct temperature switch 74 can cycle compressor 24 on and off while allowing cool air fan 10 to remain on during a cool demand cycle. System 2 has been described in terms of a forced air cooling system. If desired cool air fan 10 could be replaced by a pump to force other fluids, such as water, past evaporator 14. The invention is also adaptable for use with room air conditioners of the type mounted through an opening in the wall.

Other modification and variation can be made to the disclosed embodiment without departing from the subject of the invention as defined in the following claims.

I claim:

1. A system for cooling an enclosed region comprising:

a vapor compression refrigeration loop including:

a compressor, and expansion valve, an evaporator and a condenser fluidly coupled in a closed loop;

a cool fluid propelling means, having an inlet and an outlet, for propelling a fluid along a cool fluid path past said evaporator to cool the fluid; and a cool fluid supply conduit connecting an exit end of the cool fluid path to the region;

first and second higher voltage lines electrically connecting a higher voltage source to said cool fluid propelling means and to said compressor respectively;

first and second normally open relay switches connected along said first and second higher voltage lines;

a thermostat adapted to respond to the temperature in the region and assume a cold demand state according to the temperature in the region, said thermostat including an input terminal connected to a lower voltage source and an output terminal connected in parallel along first and second lower voltage lines to first and second relay actuators, said first and second relay actuators operably connected to said first and second relay switches;

a first relay switch actuator connected to said thermostat along the first lower voltage line, for closing said first relay switch so to actuate said cool fluid propelling means when said thermostat is in the cold demand state;

second relay switch actuator connected to said thermostat along the second lower voltage line, for closing said second relay switch so to activate said compressor when said thermostat is in the cold demand state;

a temperature sensor arranged and adapted to sense the temperature of the fluid passing through said cool fluid supply conduit; and duct switch means, operably coupled to the temperature sensor, for interrupting a portion of said lower voltage line, to deenergize said second relay switch actuator thereby disconnecting said compressor from the higher voltage source, when the temperature sensed by said temperature sensor is below a first temperature and to reconnect the interrupted portion of said second lower voltage line when the temperature sensed by said temperature sensor is above a second temperature, whereby said compressor is cycled on and off while said thermostat is in said cold demand state.

2. The cooling system of claim 1 wherein said duct switch means includes a duct switch along the switch line.

3. A system for cooling an enclosed region comprising:

a vapor compression refrigerant loop including: a closed loop refrigerant system including an expansion valve, an evaporator, a condenser and a compressor;

a power source connected to said compressor for powering said compressor;

a first relay switch electrically connecting said power source and compressor for starting and stopping said compressor;

a cool fluid propelling means having an inlet and an outlet for propelling fluid past said evaporator to cool the fluid;

a cool fluid supply conduit for receiving fluid from said evaporator and routing fluid to said enclosed region;

said cool fluid propelling means connected to the power source for operating said cool fluid propelling means;

a second relay switch electrically connecting said power source and said cool fluid propelling means for starting and stopping said cool fluid propelling means;

a thermostat adapted to respond to the temperature in the enclosed region and assume a cold demand state according to the temperature in said region and output a closing voltage to first and second relay actuators associated with said first and second relay switches;

a duct switch connected between said thermostat and said first relay actuator; and a temperature sensor arranged and adapted to sense the temperature of the fluid passing through said cool fluid supply conduit to open said duct switch when said temperature is below a first temperature and to reclose said duct switch when said temperature is above a second temperature whereby said compressor is cycled on and off while said thermostat is in said cold demand state responsive to said temperature sensor.

* * * * *